United States Patent [19]

Tennis

[11] 3,989,062

[45] Nov. 2, 1976

[54] SOURCE FLUID SUPPLY AND PRESSURE CONTROL SYSTEM FOR HYDRAULIC MOTORS

[75] Inventor: Francis H. Tennis, Oconomowoc, Wis.

[73] Assignee: Hydraulic Industries, Inc., Hartland, Wis.

[22] Filed: May 9, 1975

[21] Appl. No.: 576,219

[52] U.S. Cl. ..... 137/596.13; 60/452; 137/115

[51] Int. Cl.[2] ..... F15B 13/08

[58] Field of Search ..... 91/436; 60/445, 450, 60/452, 462, 468; 137/115, 117, 596.12, 596.13

[56] References Cited

UNITED STATES PATENTS

| | | | |
|---|---|---|---|
| 2,255,783 | 9/1941 | Kendrick | 60/468 X |
| 2,892,312 | 6/1959 | Allen et al. | 60/468 X |
| 3,444,689 | 5/1969 | Budzich | 60/445 X |
| 3,470,694 | 10/1969 | Budzich | 60/452 X |
| 3,722,543 | 3/1973 | Tennis | 137/596.12 |
| 3,742,982 | 7/1973 | Miller | 60/452 X |
| 3,754,400 | 8/1973 | Parquet | 60/452 X |
| 3,809,501 | 5/1974 | Weisenbach | 60/452 X |

*Primary Examiner*—Alan Cohan
*Assistant Examiner*—Gerald A. Michalsky
*Attorney, Agent, or Firm*—Ira Milton Jones

[57] ABSTRACT

A source fluid supply and pressure control system for hydraulic motors, comprising a motor control valve having valve instrumentalities to govern pressure at its inlet and at its motor ports, and to also limit the supply of source fluid to the inlet in accordance with demand.

11 Claims, 5 Drawing Figures

SOURCE FLUID SUPPLY AND PRESSURE CONTROL SYSTEM FOR HYDRAULIC MOTORS

This invention relates to fluid pressure operated systems, and has more particular reference to apparatus for controlling flow of pressure fluid from a source thereof to a reversible fluid motor which must at times be operated at selected slow speeds and is at other times subject to cavitation because fluid cannot be supplied to one side thereof as fast as fluid is discharged from its other side.

The operation of a hydraulic cylinder or other fluid motor at a selected uniform rate of speed involves the provision of a motor control valve instrumentality having an inlet connected with a pressure fluid source, a motor port connected with the motor, and a valve spool operable to direct pressure fluid from the source to the motor port. The motor control valve instrumentality may also comprise a pressure compensating valve mechanism which regulates flow of source fluid to the motor in accordance with variations in the pressure differential between fluid at said motor port and source fluid at the inlet of the control valve. If the control instrumentality provides for the control of a reversible fluid motor, such as a double acting hydraulic cylinder, it will have a second motor port connected with the motor, and the pressure compensating valve can operate equally well to govern flow to that second motor port.

An example of such a motor control instrumentality can be found in Tennis U.S. Pat. No. 3,722,543, issued Mar. 27, 1973, which discloses a control valve having a number of valve spools to govern flow of fluid to and from a like number of double acting hydraulic cylinders. In addition, a separate pressure compensating valve mechanism is provided for each spool, to assure that the cylinder governed thereby will operate at a uniform speed. In that control instrumentality there is a relief bypass between the inlet port and an outlet passage connecting with a tank port, and a relief valve mechanism in that bypass controls flow of fluid therethrough. When the several valve spools are in their neutral positions, a pump which has its output port connected with the inlet of the control valve can be "unloaded" through the relief bypass. The relief valve mechanism is of the type that is held closed by pressure of inlet fluid in a chamber at its rear, but opens in response to inlet pressure whenever the chamber behind it is vented.

The chamber behind the relief valve is vented through a venting passage that leads from said chamber, serially through the bores containing the valve spools, to a suitable exhaust port. When any valve spool is initially moved from its neutral position toward an operating position, the venting passage is blocked by that spool, and because of such closure of the venting passage, inlet fluid that flows into the pressure chamber becomes trapped therein so as to maintain the relief valve mechanism closed during the time the actuated valve spool is in an operating position.

Heretofore it frequently happened that a pressure spike was created at the instant of such closure of the venting passage for the chamber of the relief valve mechanism. A pressure spike can be defined as a substantially instantaneous rise in inlet pressure to an objectionably high value. A pressure spike occurred because the strong spring acting upon the plunger of the compensating valve associated with the actuated valve spool prevented instant response of the plunger to rising inlet pressure, so that such pressure could rise to a high value before it was relieved by movement of the compensating valve plunger to a position in which it allowed surplus pump fluid entering the compensator inlet to flow to an excess fluid passage, such as a tank port in the pressure compensating mechanism.

These pressure spikes become more intense in control valves wherein surplus pump fluid must be led through one after another of the pressure compensating valve mechanisms for a number of control valves before reaching a return passage. In addition, pressure spikes can occur at times when a control valve spool is moved from one operating position to another, as for example upon partial movement of a valve spool towards its neutral position, to reduce the flow of pump fluid to the governed cylinder.

In general, therefore, it is one of the objects of the invention to provide a solution to the problem of pressure spikes in pressure compensating control valves of the character described.

In a more specific sense, it is an object of the invention to provide a pressure compensated control valve of the character described, having a relief valve mechanism at its inlet, wherein the relief valve mechanism is associated with a controller that has a fluid pressure sensitive valve member, which controller in effect serves as a pilot that causes the relief valve mechanism to open for the relief of inlet pressure before such pressure can spike to an objectionably high value.

It is a further purpose of the invention to provide a controller such as just described, characterized by a valve member which is adapted to be opened by pressure of fluid at the control valve inlet but which is urged closed under force exerted thereon by pressure of feedback fluid in a passage connecting the inlet of the control valve with the motor ports thereof, so that the closing force on said valve member will vary in accordance with the load on the governed motor.

Still another object of the invention resides in the provision of a controller such as mentioned above, which can be made to control inlet pressure in an associated control valve by effecting actuation of stroke adjusting means for a variable displacement pump that has its output port connected with the control valve inlet, so that destroking adjustment of the pump takes place whenever pressure at the control valve inlet rises to a value such as to cause the controller valve member to open.

In this connection, it is another object of the invention to provide control apparatus such as described in the preceding object, with void control means comprising a pressure sensitive valve mechanism that opens to admit pressure fluid from the control valve inlet to the exhaust passage means thereof whenever the pressure in the latter drops to a value below the setting of a low pressure relief valve governing flow of motor exhaust fluid to an outlet passage, so as to thereby make inlet fluid available for void prevention through conventional anti-void check valves in void relief passages connecting the motor ports with the exhaust passage means.

With these observations and objectives in mind, the manner in which the invention achieves its purposes will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of the embodiments of the invention constructed according to the best modes so far devised for the practical application of the principles thereof, and in which.

Figure 1:
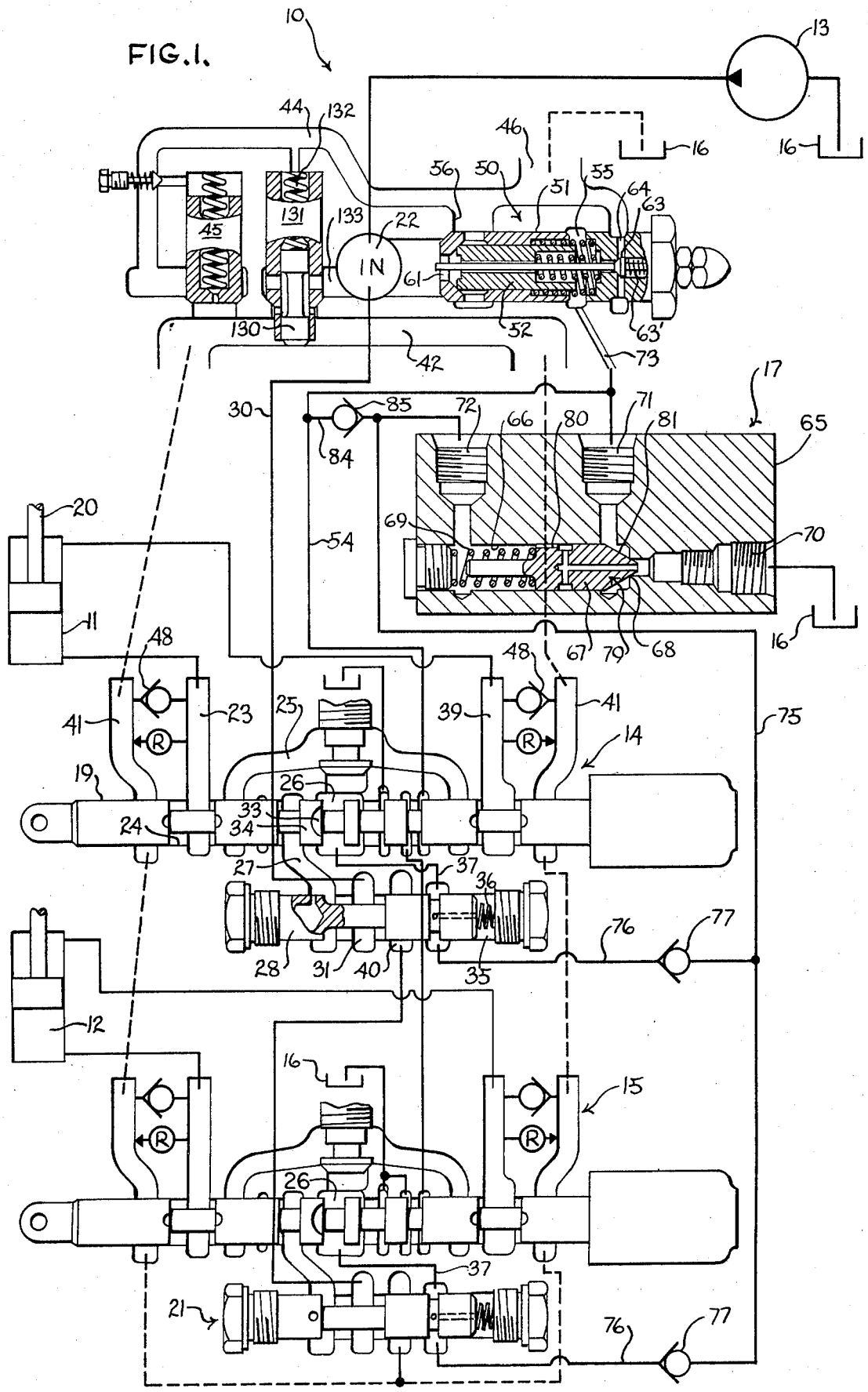
FIG. 1 is a diagrammatic view of a hydraulic system embodying a controller of this invention.

Referring now particularly to the accompanying drawings, the numeral 10 in FIG. 1 generally designates a control system comprising a pair of double acting hydraulic cylinders 11 and 12, a pump 13 providing a pressure fluid source, and control valves 14 and 15 to govern communication of the respective cylinders with the pump and with the reservoir 16 of the system.

The system is generally the same as that disclosed in the aforesaid Tennis U.S. Pat. No. 3,722,543, except that it comprises only two control valves, and it additionally features a controller of this invention, generally designated 17. As will be described hereinafter, the purpose of the controller is to prevent objectionable pressure spikes such as ordinarily occur in hydraulic systems governed by pressure compensated control valves at times when the latter are actuated from neutral to an operating position, or from one operating position to another.

Since reference may be had to the aforesaid Tennis patent for a detailed description of the system, it will suffice here merely to outline the normal operation thereof as a consequence of actuation of the spool 19 of the upstream one of the two identical control valves 14 and 15 to a partial operating position, in which that spool directs a metered amount of pressure fluid from the pump to the cylinder 11, for operation of the latter at a selected speed.

If the spool 19 is shifted to such a partial operating position to the right of its neutral position shown, it will effect extension of the piston rod 20 of the governed cylinder 11 at a rate which will be maintained constant due to the operation of a pressure compensating valve mechanism 21, through which the control valve 14 is supplied with pressure fluid from the pump-connected inlet 22 thereof.

In said operating position of the spool 19, the left hand motor or service port 23 of the control valve is communicated through the spool bore 24 which the adjacent leg of bridge passage 25 of inverted U-shape. The bridge passage 25 comprises the downstream portion of a feeder passage through which the motor ports 23 and 39 are alternatively communicable with the inlet 22 under the control of the valve spool. The legs of the bridge passage communicate with the spool bore 24 at axially spaced zones that lie at opposite sides of a medial zone of the bore which constitutes the inlet 26 to the downstream bridge passage portion of the feeder passage. The upstream portion 27 of the feeder passage connects the spool bore with the bore in which the plunger 28 of the pressure compensating valve mechanism operates.

Pressure fluid flows from the inlet 22 through a supply passage 30 to the inlet port 31 of the pressure compensating valve mechanism 21, and through a groove in the plunger 28 of the latter to the upstream portion 27 of the feeder passage.

The upstream and downstream portions of the feeder passage are communicated with one another in said right hand partial operating position of the spool 19 through an orifice defined by one or more throttle notches 33 in a metering land 34 on the spool. Accordingly, pump fluid flows to the head end of cylinder 11 along a path leading from the inlet 22 through the supply passage 30, the bore of the pressure compensating valve mechanism, the upstream and downstream branches 27 and 25, respectively, of the feeder passage and the orifice 33 connecting those branches, and the motor port 23 then connected with the bridge passage 25.

The plunger 28 of the pressure compensating mechanism 21 functions to maintain the flow of fluid to the cylinder at a constant rate, for operation of the cylinder at a controlled speed co-responding to the metering setting of the valve spool 19. It does so in the conventional manner, by maintaining a substantially constant pressure drop across the orifice defined by the throttle notch 33. This is to say that the plunger 28 of the pressure compensating valve mechanism regulates fluid flow to the motor port 23 in accordance with variations in the pressure differential across the valve spool 19, between the upstream and downstream portions 27 and 25 of the feeder passage.

To provide for such operation of the pressure compensating valve mechanism, the pressure of supply fluid in the upstream portion 27 of the feeder passage is imposed on the left hand end of the plunger 28 in a well known way, while the pressure of fluid at the inlet 26 to the bridge passage 25 is fed back to and imposed upon the right hand end of the plunger in a chamber 35, to augment the force exerted thereon by a strong spring 36 in said chamber. For such feedback, a passage 37 communicates the portion 26 of the spool bore 24 with the spring or feedback chamber of the pressure compensating valve mechanism.

The operation is the same as described above when the valve spool 19 is shifted to the left, to effect delivery of pressure fluid to its motor port 39 and thus cause retracting motion of the piston rod of cylinder 11 at a preselected speed.

In either case, it should be noted that the pressure compensating mechanism 21 functions to divert excess supply fluid to an excess fluid or reservoir port 40 of the mechanism. In the two-valve unit shown, the reservoir port 40 of the upstream pressure compensating valve mechanism 21 is connected to the inlet port of its counterpart downstream mechanism, and the reservior port of the latter is communicated with exhaust passage means described below.

Fluid expelled from the cylinder during extension or retraction of its piston rod is directed by the valve spool 19 to one or the other pair of exhaust passages 41 that connect with an exhaust header 42. The passages 41 and the header 42 can be considered as providing exhaust passage means that can be communicated with an outlet passage 44 through a low pressure relief valve 45. The relief valve 45 functions to normally restrict exhaust flow to the reservoir or outlet port 46 and thus maintains exhaust fluid in the header 42 at a predetermined pressure above that of fluid in the outlet passage 44. Through an antivoid check valve 48 for each motor port 23, 39 such pressurized exhaust fluid can thus flow back to a motor port connected with the pump whenever the pressure of pump fluid at that motor port drops to a value below that of fluid in the exhaust passage means, to minimize or even prevent void formation in the governed cylinder.

The system also includes a relief valve mechanism 50 which is shown as comprising a hollow unloading valve 51 and a bypass valve 52 in the hollow interior of the unloading valve. Both the unloading valve and the bypass valve in its interior are spring urged towards closed positions. Pressure at the inlet 22 is imposed upon the front end of the unloading valve to exert a force which is in opposition to the spring force upon it and which tends to open it. A pressure chamber 55 at the rear of the relief valve mechanism is communicated in any convenient manner with the inlet 22, to receive fluid under pump pressure therefrom, and is vented through a venting passage 54 which leads serially through the spool bores 24. The venting passage is effective to vent the chamber 55 when the valve spools are in their neutral positions, so that the unloading valve can then be held open under pressure of inlet fluid thereon, to enable the pump to unload through a relief passage 56 governed by the unloading valve. Upon initial motion of either valve spool out of neutral, the venting passage 54 is closed by the actuated valve spool, and the unloading valve 51 closes under pressure of inlet fluid trapped in its chamber 55, abetted by spring force.

The inner valve 52 normally closes a bypass 61 leading from the inlet 22 to the outlet passage 44 through an annular seat formed inside the front of the hollow unloading valve and through radial holes in its wall that open to the outlet passage. The bypass valve 52 is caused to open whenever inlet pressure rises to a predetermined high relief value that effects opening of a pilot valve 63 against the closing force of its spring 63'. The pilot valve 63 governs a short venting passage 64 for the chamber 55, and when open it allows the bypass valve to open under inlet pressure on its front and thereby effect relief of the overload condition that caused the pilot valve to open.

The controller 17 acts similarly to the pilot valve 63 to effect opening of the bypass valve 52 under certain conditions, but at pressures less than the high pressure relief setting of the relief valve mechanism. For that purpose, its body 65 is provided with a bore 66 containing a valve member 67 in the form of a poppet which is movable toward and from a closed position of engagement with an annular seat 68. A spring 69 urges the valve member 67 towards its seat engaging position.

Through the valve seat 68, which is located at one end portion of the bore 66 and is coaxial therewith, that bore is communicated with a reservoir port 70 in the body. The body is also provided with two additional ports 71 and 72. The port 71 communicates with the bore 66 near the valve seat 68, and the port 72 communicates with said bore near its end remote from the valve seat, at a portion of the bore that comprises a chamber for the spring 69.

The port 71 is also communicated with the inlet 22 of the control valve in any suitable way, such as by connecting it with the pressure chamber 55 of the relief valve mechanism 50 through that portion 73 of the venting passage 54 which leads from said chamber. Port 72 is communicated with the inlets 26 of the downstream feeder passage portions by means of a passage 75 having branches 76 that communicate with the spring or feedback chambers of the pressure compensating valve mechanisms 21, and thence by way of the respective feedback passages 37 that communicate those feedback chambers with their associated inlets 26. A check valve 77 in each branch 76 assures that the controller port 72 will be subjected to the higher of the pressures in the spool bore portions 26 in the event both spools are in working positions at the same time.

The rear portion of the bore 66 containing the spring 69 for the valve member 67 is vented to the reservoir port 70 in the controller body by venting passage means 79 extending centrally through the valve member or poppet 67, opening at one end of the reservoir port 70 and opening at its other end to the spring chamber behind the poppet via an axial groove 80 in the exterior of the poppet.

From the above description of the controller, it will be seen that when the valve spools are in their neutral positions, the front 81 of the valve member 67 will be subjected to sufficient force from pressure of fluid at the inlet 22 so that said valve member will open against the force of its substantially light spring 69. Opening of the poppet 67 also effects venting of the pressure chamber 55 behind the relief valve mechanism 50 to thus allow the latter to open under inlet pressure on its front.

If either valve spool is in a working position, the earlier mentioned venting passage 54 for chamber 55 will be closed thereby, and said chamber will be closed off from the vented port 70 by the controller poppet 67. This results from the fact that the poppet is held closed by pressure of working fluid in the spring chamber of the controller, which is then subjected to the pressure of fluid in the bore portion 26 associated with the actuator spool. It can be said that fluid pressure in bore portion 26 at that time mirrors the pressure at the motor port then receiving pressure fluid from the bridge 25, to which bore portion 26 is the inlet. Thus, when a cylinder is actuated, the fluid pressure closing force acting upon the valve member 67 of the controller will correspond to the load on the governed cylinder, and that closing force is added to the force of the spring 69 to normally hold the controller valve member 67 closed against the opening force which inlet fluid then exerts upon it.

As stated earlier, the purpose of the controller is to minimize or even eliminate pressure spikes such as occur in a pressure compensated control valve at the instant of actuation of its spool to a working position, or at times when the spool is shifted from one working position to another to slow the speed of the governed cylinder.

In a conventional pressure compensated control valve, a pressure spike is produced at the instant the valve spool is moved out of its neutral position, for example, toward a metering or partial working position. At that instant, the valve spool closes the venting passage 54 for the pressure chamber 55 of the relief valve mechanism 50, and the unloading valve 51 immediately closes, due to the resulting entrapment of inlet fluid in its chamber 55. Upon such closure of the unloading valve, the pressure at the inlet 22 will usually rise abruptly to an objectionably high value because the strongly biased plunger 28 of the compensating valve mechanism 21 cannot respond quickly enough to the rising pressure in the supply passage 30 and thus cannot immediately be moved thereby to its partially open position in which it allows surplus supply fluid to flow to its excess fluid port 40.

The pressure spike which is thus ordinarily produced as the valve spool leaves its neutral position is greatly minimized or even eliminated by the controller 17 of this invention. The controller functions to relieve pressure spikes because its spring chamber will still be at zero pressure at the time pressure begins to rise abruptly at the inlet 22. Hence, only the substantially small closing force of the spring 69 is exerted on the controller poppet 67, which small force is easily overcome by the force which rising inlet pressure exerts upon the front end 81 of that valve member. Accordingly, the controller valve member 67 is forced open by inlet pressure before the plunger of the compensating valve mechanism can relieve the pressure in the supply passage 30, and before inlet pressure rises to the relief setting of the pilot poppet 63. Such opening of the controller valve member then effects venting of the chamber 55 of the relief valve mechanism 50, thereby enabling the latter to open under pressure of fluid at the inlet, to thus relieve said pressure before it can rise to any appreciable or objectionable extent.

Upon further movement of the valve spool 19 away from its neutral position, the rear or spring chamber of the controller attains a pressure substantially equal to load pressure in the bridge passage 25, with which that spring chamber is connected by the passages 75, 76 and 37. This pressure exerts sufficient closing force upon the valve member 67 of the controller, when added to that of its spring 69, to maintain the poppet closed under the higher operating pressure then present at the inlet 22 of the control valve. It should be observed, of course, that with a spool in working position and the poppet 67 of the controller back in its seated position, the chamber 55 of the relief valve mechanism is no longer vented; and the force of the then elevated inlet pressure in chamber 55 added to that of the springs acting upon the unloading and bypass valves 51 and 52 is sufficient to hold said valves closed.

In the event the valve spool 19 is thereafter moved toward neutral, to a partial operating position further limiting flow of supply fluid to the cylinder 11, the pressure of fluid at the inlet 22 will again rise abruptly, before the plunger of its compensating valve can react, to again cause the controller poppet 67 to open and vent the relief valve chamber 55. The bypass valve 52 then quickly opens to relieve inlet pressure before it can spike to an objectionably high value. In each described instance, the controller poppet 67 opens at a pressure well below the relief setting of the relief valve mechanism, which is to say that it will open under inlet pressure which, though high, is insufficient to cause opening of the pilot poppet 63. Also, the controller poppet will reclose under pressure of feedback fluid in its spring chamber as soon as the plunger of the compensating valve for the operating control valve can react to the increasing pressure in the supply passage 30 resulting from actuation of the valve spool 19.

The control valve mechanism shown in FIG. 1 is of the open center type wherein all pump fluid is dumped through the unloading valve 51 when the valve spools are in their neutral positions. In the normal service position of either valve spool, however, the unloading valve remains closed, and any excess pump fluid is routed to the return header through the excess fluid ports of the compensating valve mechanisms 21.

Figure 4:
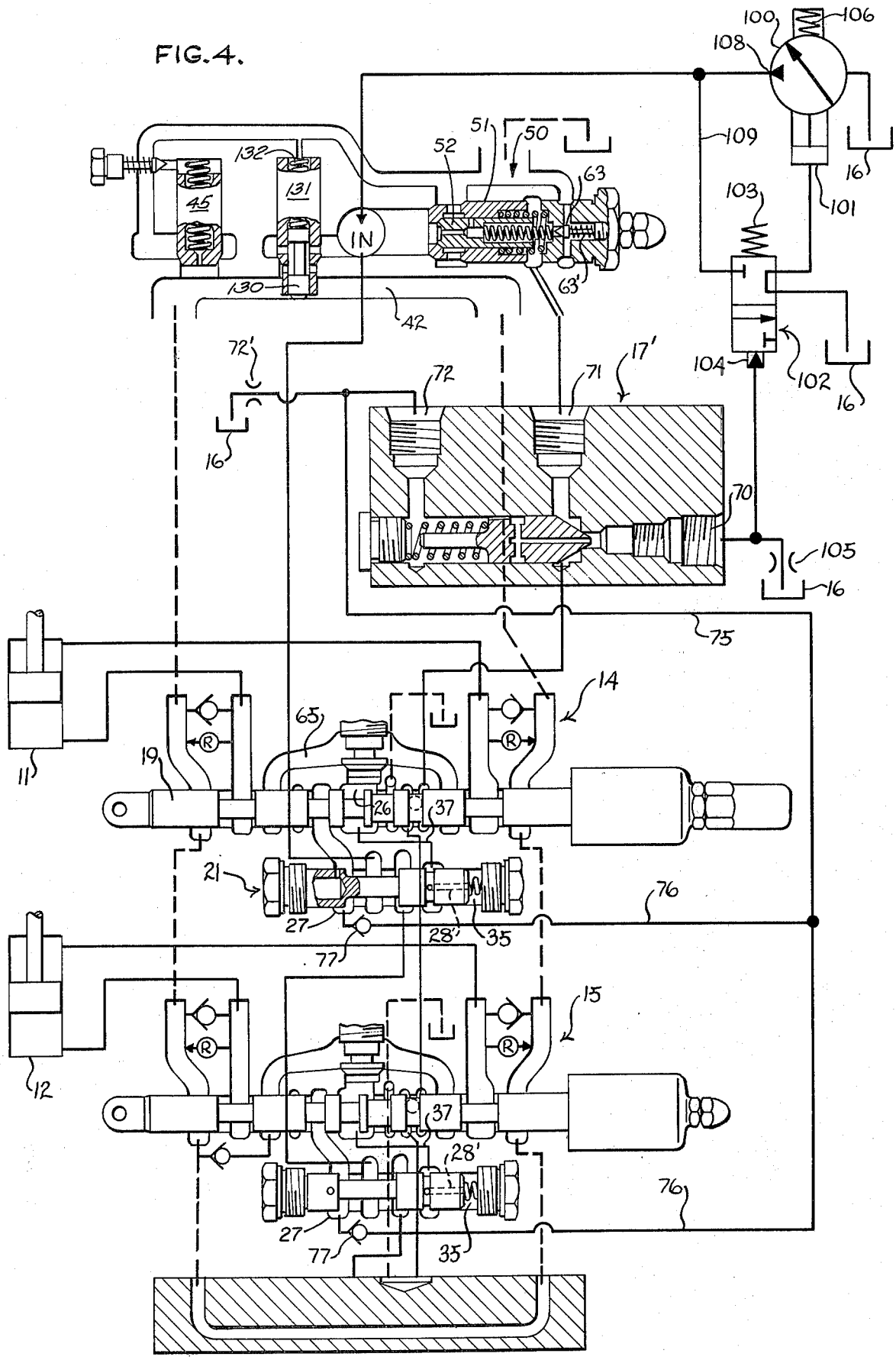
FIG. 4 is a diagrammatic view similar to FIG. 1 but illustrating another embodiment of the invention.

The system illustrated in FIG. 4 is like that described above, except that it portrays a closed center control valve arrangement. Here, a controller 17′ also relieves or prevents spike pressures in the manner described; but excess pump fluid in this case is relieved through the bypass valve 52 rather than through the compensating valves. In this case, the controller port 72 has been shown connected to the reservoir 16 through a restriction 72′ and connected to the upstream feeder passage branches 27 of the pressure compensating valves by the ducts 75 and 76. Another slight distinction resides in the way that the pressure of feedback fluid is manifested in the spring chambers of the compensators. As shown in FIG. 4, each feedback passage 37 leads from its bridge entrance 26 to a blind chamber in the bore of its pressure compensating valve mechanism, and a passage 28′ in the plunger thereof communicates said blind chamber with the spring chamber 35.

Figure 2:
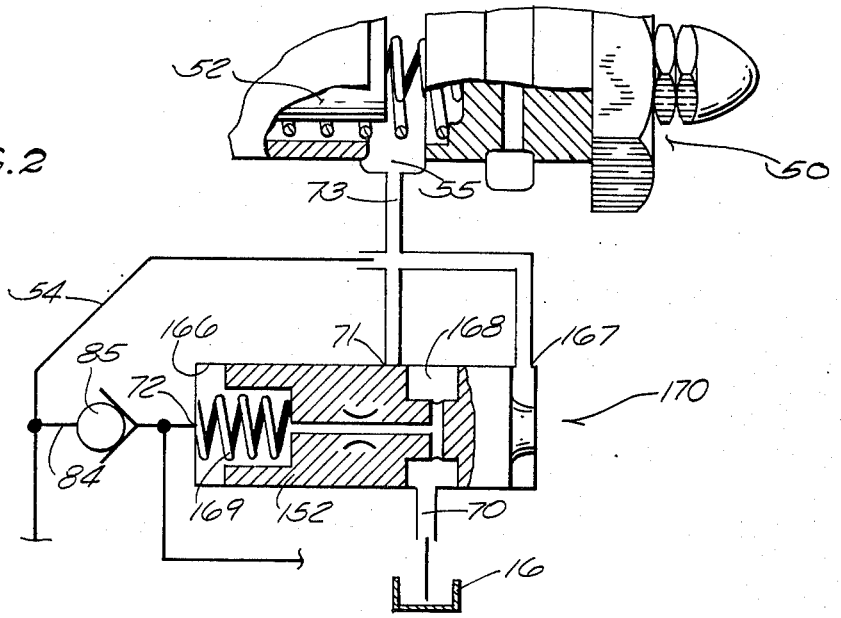
FIG. 2 is a fragmentary view illustrating a modification of the controller seen in FIG. 1.

The elimination of spike pressures can also be achieved with a controller 170 such as seen in FIG. 2, having a spool type valve 152 slidably axially back and forth in a bore 166. A spring 169 confined in the closed left hand end of the bore 166, behind the spool 152, normally holds the spool at its right hand limit of motion, engaging a stop defined by the closed right hand end of the bore.

In this case, the controller body has a port 71 in its side, intermediate its end, and has another port 167 opening from the right hand end of its bore 166; and both of these ports are connected with the chamber 55 of the relief valve mechanism 50 by way of that portion 73 of the relief valve venting passage 54 which leads from said chamber 55. Accordingly inlet fluid will always be present in the closed right hand end of the bore 166 to exert opening force on the valve member 152.

The reservoir port 70 opens from the bore 166 at a location therealong such that communication between it and the port 71 is blocked by the spool when the latter is at its right hand limit of motion. Whenever inlet pressure causes the valve member to shift to the left, against the action of its spring 169, a circumferential groove 168 in the exterior of the valve member 152 provides communication between the inlet connected port 71 and the reservoir port 70. As before, this vents the chamber 55 behind the bypass valve 52, to effect opening of the latter for the relief of any pressure spike at the inlet before it can rise to an objectionably high value.

In the FIG. 2 embodiment, as well as in the FIG. 1 embodiment, it can be advantageous to connect the port 72 of the controller with the venting passage 54, through a passage 84 containing a check valve 85 which opens in the direction to let fluid out of the controller spring chamber. This feature, which provides for exceptionally good drainage of the spring chamber of the controller, is optional, although better opening response of the controller valve member can be achieved thereby at times when one of the control valve spools begins to leave its neutral position as it is actuated toward a partial operating position as described.

Figure 3:
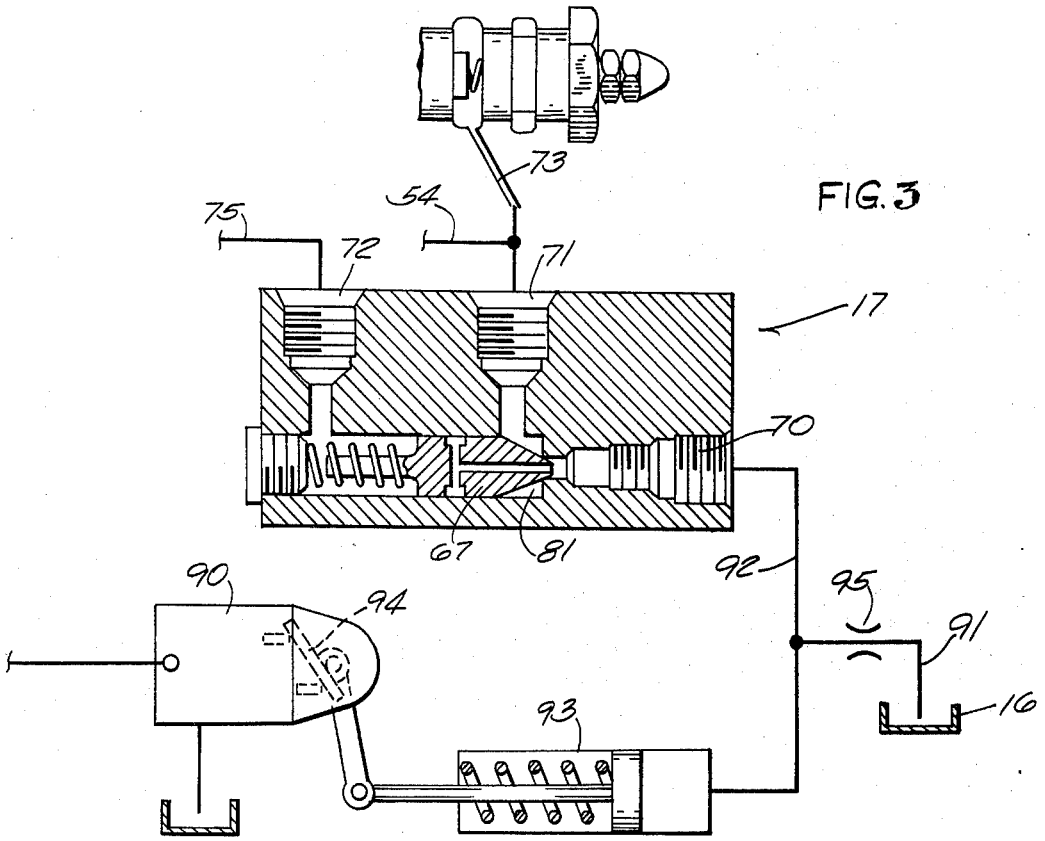
FIG. 3 is fragmentary diagrammatic view illustrating a portion of a system like that seen in FIG. 1, but wherein the controller governs operation of instrumentalities for adjusting the stroke of a variable displacement pump for the system.

In the FIG. 3 embodiment of the invention, a controller 17 of the poppet type seen in FIG. 1 is again relied upon to prevent pressure spikes and thereby govern inlet pressure as hereinbefore described. It also helps to control inlet pressure at times when there is a decreasing demand for pump fluid by effecting destroking of a variable displacement pump 90 from which the fluid is supplied.

For this purpose, the port 70 of the controller is connected by a passage 92 with the actuating cylinder 93 for stroke adjusting means 94 of the pump. The stroke adjusting means, as for instance a swash plate such as shown, is normally spring biased to its full stroke position seen in broken lines in FIG. 3. When pressure fluid is introduced into the head end of its actuating cylinder 93 via the passage 92, however, the swash plate is caused to swing in the destroking direction.

Such destroking of the pump is effected each time the poppet 67 of the controller is moved off of its seat by the force which inlet fluid exerts upon its front end 81. Inlet fluid then can flow out of the reservoir port 70 to the head end of actuating cylinder 93, although some of said fluid can flow to the reservoir 16 through a branch 91 of passage 92 in which there is a flow restriction 95.

The controller valve member will of course be opened at any time a valve spool is initially moved out of neutral and inlet pressure rises in relation to pressure at the entrance 26 to the bridge passage 25, and the controller will thus prevent pressure spikes by its own action; but when such pressure rise is due to reduced demand for pump fluid and correspondingly reduced pressure in the controller spring chamber, opening of the controller valve member can effect destroking of the pump, in the manner described above, thereby reducing pump delivery and accordingly effecting decrease in inlet pressure. As soon as demand for pump fluid increases, the controller valve member will close in response to the increase in feedback or load pressure then occurring in its spring chamber, and the spring bias on the swash plate of the pump will cause it to swing in the displacement increasing direction.

Such destroking of a variable displacement pump can also be accomplished in the manner seen in FIG. 4, upon opening of the poppet 67 of its controller 17'. As therein seen, the stroke adjusting mechanism for the pump 100 comprises an actuating cylinder 101, on the order of the cylinder 93 provided in the FIG. 3 embodiment, and a valve device 102 biased by a spring 103 to a normal full stroke or inactive position.

The valve device 102 has a pilot port 104 which is connected to the reservoir port 70 of the controller, and port 70 is again connected to the reservoir 16 through a passage having a flow restriction 105 therein.

Normally, the head end of cylinder 101 is connected with the reservoir 16 through the valve device 102, so that the spring 106 for the stroke adjusting mechanism of the pump can act to hold said mechanism in its maximum stroke condition.

Whenever the controller poppet 67 opens as a result of the rise in inlet pressure that occurs at times when demand for pump fluid decreases, inlet fluid issues from the reservoir port 70 of the controller and flows to the pilot port 104 of the valve device 102. By such flow to its pilot port, the valve device is actuated to an active position at which it disconnects the head end of cylinder 101 from the reservoir and instead connects it with the output port 108 of the pump through a duct 109. Pump fluid can then flow into the cylinder 101 to effect destroking of the pump to such an extent as to effect a balance between demand and pump output.

Again in this case, when the demand for pump fluid increases, the higher pressure then present at the entrance 26 to the bridge passage 25 and the controller spring chamber effects closure of the controller poppet so that the valve device 102 can be returned to its inactive position, and the spring 106 for the pump destroking mechanism can actuate the latter to increase pump displacement.

It will be understood that the cylinder 101 and the valve device 102 will normally be located inside the pump 100, where it can assure the most rapid stroke increasing and decreasing adjustments in the mechanism controlling pump stroke.

Figure 5:
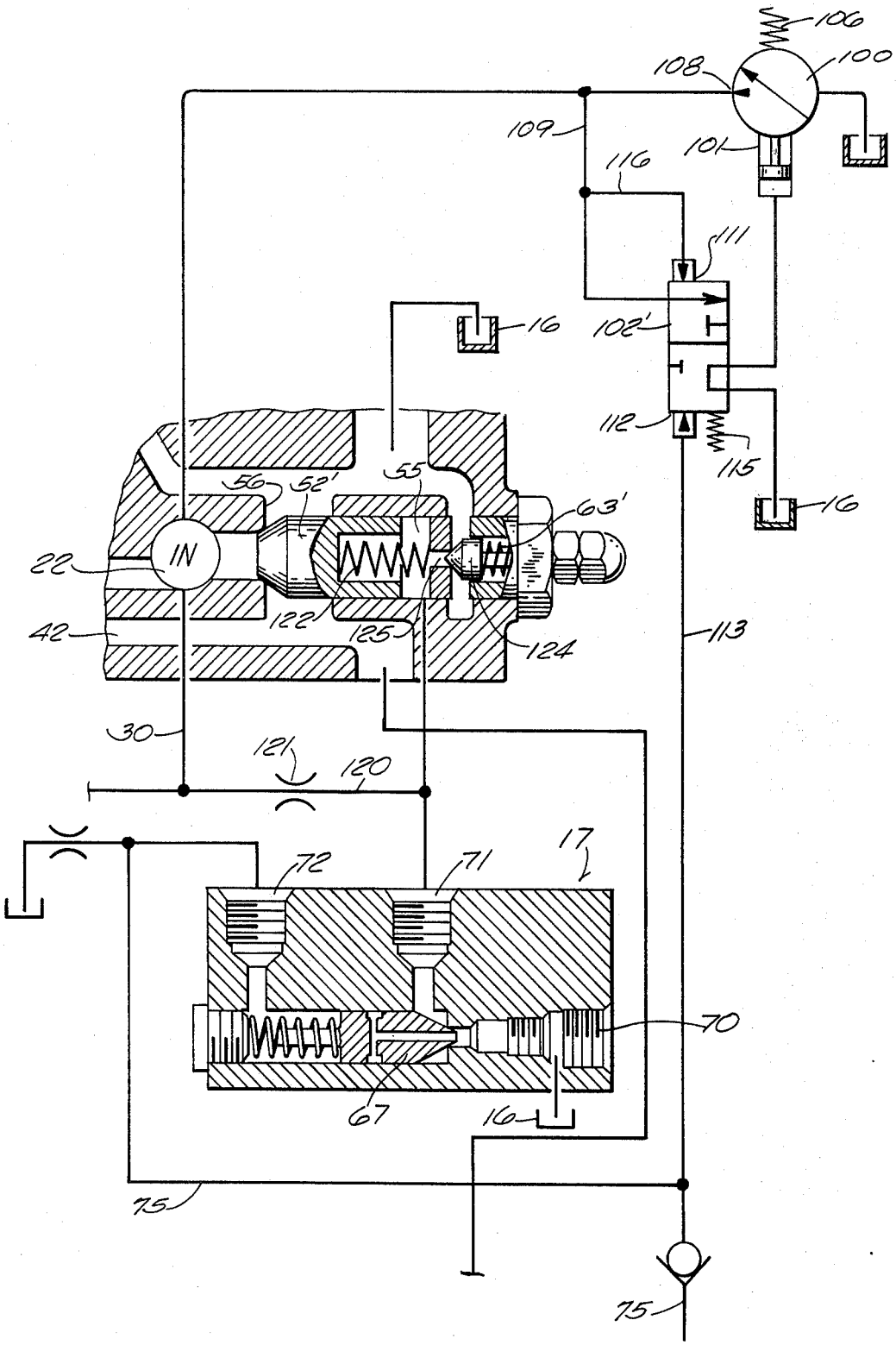
FIG. 5 is a diagrammatic view illustrating a portion of a hydraulic system embodying still another form of the invention.

In the embodiment of the invention seen in FIG. 5, the stroke adjusting mechanism for the pump 100 comprises a fluid pressure actuated valve device 102' having two pilot ports 111 and 112, so that it can be actuated to both of its positions by fluid pressure. As before, the actuating cylinder 101 for the stroke adjusting mechanism is normally connected with the reservoir 16 through the valve device 102'. The valve device 102', however, is normally held in the inactive position in which it is shown, by pressure of fluid delivered to the pilot port 112 through a pilot branch 113 of the passage 75 that connects with the spring or feedback chambers of the pressure compensating valve mechanisms 21 and also leads to the controller port 72. A spring 115 helps hold the valve device in this inactive position.

The other pilot port 111 of the valve device 102' is connected with the pump output port 108 through a branch 116 of the duct 109 that supplies fluid to the destroking cylinder 101 to actuate the same when the valve device is shifted to an active position. The valve device is shifted to such an active position in consequence of the rise in pressure at the control valve inlet that takes place whenever there is a decrease in the demand for pump fluid.

When demand for fluid increases, the pressure of feedback fluid in passage 75 and branch 113 thereof rises and effects shifting of the valve device toward its inactive position shown, to then allow the spring 106 to move the pump stroke adjusting means in the stroke increasing direction.

The embodiment of the invention seen in FIG. 5 features a relief valve mechanism comprising a single valve member 52' governing the bypass 56. The pressure of fluid at the inlet 22 exerts opening force upon the front of the valve member 52' and also upon its rear. For exerting pressure on the rear of the valve member 52', the chamber 55 behind it is connected with the supply passage 30 and hence with the inlet 22 through a passage 120 containing a restriction 121.

A spring 122 also acts on the rear of the valve member 52' to urge it toward its closed position shown.

A pilot valve 124 normally closes a venting passage 125 for chamber 55, but when the pressure of fluid in said chamber rises to a predetermined high relief value, the pilot valve is opened thereby to effect venting of chamber 55. At that time, the valve member 52' opens under force of inlet fluid on its front, to relieve overload pressure at the inlet.

In this case also, the controller poppet 67 is subjected to opening force be reason of its port 71 being connected with the branch 120 of the supply passage 30; while the controller port 70 is connected only to the reservoir 16. The controller, of course, operates to relieve pressure spikes that cannot be dealt with by pump destroking means; but the latter is highly advantageous for cutting down the amount of unneeded fluid flowing to the inlet 22.

There may be times when the earlier described void relief flow from the exhaust passage means to the pump-connected motor port may not be sufficient to cure a void in the expanding end of the cylinder. This is especially true when exhaust fluid from the rod end of cylinder 11 is recirculated back to the motor port 23 through the anti-void check valve for that motor port, at times when the load on the piston rod 20 causes the space in the head end of cylinder 11 to expand at a rate faster than pump fluid and exhaust fluid can flow into said port.

At such a time, the pressure in the exhaust header 42 drops to a value below the setting of the low pressure relief valve 45, causing the same to close. At the same time, the drop in pressure in the exhaust header effects opening of the valve element 130 of a pressure reducing valve mechanism 131 by its spring 132. In the open position of the valve element 130 seen in FIG. 1, the valve mechanism 131 communicates the valve inlet with the exhaust header 42 through a bypass or make-up passage 133, to thus allow pump fluid to be delivered directly to the exhaust header where it is available for void relief flow to the starving end of cylinder 11 via motor port 23 and its associated anti-void check valve 48.

The valve element 130 of the pressure responsive valve mechanism 131 is held in a position closing the bypass 133 by pressure in the exhaust header 42 during all normal operation of the cylinder 11. The pressure in the exhaust header 42 assures that the valve element 130 will remain in its closed position as long as the pressure in the exhaust header is at a predetermined value depending more or less upon the setting of the low pressure relief valve 45. Thus, the relief valve will close and the pressure responsive valve will open whenever the pressure in the exhaust header drops to a value below the setting of the low pressure relief valve 45.

Merely by way of example, the low pressure relief valve may be set to open at pressures in the exhaust header above 150 psi, and to close when the pressure drops below that value; while the valve element 130 of the pressure responsive valve 131 may be set to open at a pressure of 100 psi in the header 42. The pump 13, for example, may have a capacity of 100 g.p.m.

Thus, if the valve spool 19 is placed in a metering position at which it effects delivery of 10 g.p.m. of pump fluid to the head end of cylinder 11 via motor port 23, its compensating valve mechanism will act to maintain the flow of pump fluid to the cylinder at said 10 g.p.m. rate despite variations in the load on the cylinder.

If the load on the cylinder then creates a void in its head end such as could only be relieved by an additional 5 g.p.m. of pump fluid, added to the flow of exhaust fluid from the rod end of the cylinder back to motor port 23 via its anti-void check valve, the pressure in the exhaust header will drop to a value, of say 90 psi, causing the low pressure relief valve 45 to close and the valve element 130 of mechanism 131 to open under the action of its spring 132. This lets pump fluid flow directly into the exhaust header as described earlier.

Accordingly, if the pump is of the constant displacement type, the necessary amount of pump fluid will be available for flow into the exhaust passage means past the valve element 130, for void relief. If the pump is of the variable displacement type, the pressure compensating valve mechanism 21 will cooperate with the controller 17 to effect adjustment of pump displacement to increase pump output the additional 5 g.p.m. necessary to relieve the void in the expanding head end of the cylinder.

Consequently, with the variable displacement pump embodiments, the pressure compensating valve mechanism 21 cooperates with the controller 17 to always assure that enough fluid flows to the expanding end of the cylinder.

From the foregoing description, together with the accompanying drawings, it will be apparent to those skilled in the art that this invention provides for control of pressure at the inlet of a control valve by especially simple but highly effective means.

Those skilled in the art will appreciate that the invention can be embodied in forms other than as herein disclosed for purposes of illustration.

The invention is defined by the following claims.

I claim:

1. In combination with a control valve having a valve spool movable to a working position to effect flow of fluid from a pressure fluid inlet to a motor port via a feeder passage which extends across the spool:

A. a pressure compensating valve mechanism to regulate flow of pressure fluid to the motor port in accordance with variations in the pressure drop across the valve spool in said working position thereof;

B. first normally closed pressure responsive valve means connected with the inlet to effect relief of pressure thereat when opened;

C. a controller connected with the inlet and having a valve member adapted to be opened under force which inlet fluid exerts thereon, and which, when opened, effects opening of said first pressure responsive valve means;

D. means to apply a first closing force on said valve member;

E. means rendered operative by the valve spool in said working position thereof for translating the pressure of fluid in the feeder passage into an additional closing force on said valve member;

F. second pressure responsive valve means which, when opened, effects opening of said first pressure responsive valve means;

G. means for translating the pressure of fluid at the inlet into opening force on said second pressure responsive valve means;

H. and means yieldingly urging said second pressure responsive valve means closed with a force which exceeds the total of said first and additional closing forces on the controller valve member.

2. The combination of claim 1, further characterized by:

A. two motor ports for connection with the opposite sides of a reversible fluid motor;

B. exhaust passage means;

C. the valve spool being movable to a pair of working positions to communicate the inlet with either motor port through said feeder passage and at the same time to communicate the other motor port with said exhaust passage means;

D. and the valve spool being operable in both of its said working positions to translate feeder passage pressure into said additional closing force on the controller valve member.

3. In combination with a control valve having a valve spool movable to a working position to effect flow of fluid from a pressure fluid inlet to a motor port via a feeder passage which extends across the spool:

A. a pressure compensating valve mechanism to regulate flow of pressure fluid to the motor port in accordance with variations in the pressure drop across the valve spool in said working position thereof;

B. means for relieving pressure at the inlet comprising a bypass connected therewith, a bypass valve normally closing said bypass but adapted to be opened by pressure of inlet fluid thereon, and a pressure chamber which is connected with the inlet and which must be vented before the bypass valve can open;

C. first and second valve mechanisms each connected with the inlet and having a valve member subjected to force which inlet fluid exerts thereon and adapted to be opened thereby to effect venting of said chamber;

D. means to apply a first closing force on the valve member of said first valve mechanism;

E. means rendered operative by the valve spool in said working position thereof for translating feeder passage pressure into an additional closing force on the valve member of said first valve mechanism;

F. and means yieldingly urging the valve member of said second valve mechanism closed with a force which exceeds the total of said first and additional closing forces on the valve member of said first valve mechanism.

4. The combination of claim 3, further characterized by:

A. said valve spool being movable to a pair of working positions to communicate either of two motor ports with the inlet and the other motor port with exhaust passage means;

B. and the spool being operable in both of said working positions thereof to translate feeder passage pressure into said additional closing forces on the valve member of said first valve mechanism.

5. In combination with a control valve having a valve spool movable from a neutral position to a working position to effect flow of fluid from a pressure fluid inlet to a motor port via a feeder passage:

A. means for relieving pressure at the inlet comprising a bypass connecting therewith, a bypass valve normally closing said bypass and adapted to be opened by pressure of inlet fluid thereon, and a pressure chamber connected with the inlet and which must be vented before the bypass valve can open;

B. means providing a venting passage connecting with said chamber and controlled by the valve spool to be rendered effective thereby in only said neutral position of the spool;

C. a controller connected with the inlet and with said chamber, and having a pressure responsive valve member subjected to inlet pressure to be opened thereby and when open, to effect venting of said chamber;

D. spring means to apply a first closing force on said valve member;

E. means providing a pressure chamber forming part of said controller, in which said spring is received;

F. means rendered operative by the valve spool in said working position thereof for communicating the feeder passage with said controller chamber so that fluid pressure in said controller chamber exerts additional closing force on the controller valve member;

G. and means providing a check valve controlled passage communicating said controller chamber with said venting passage through which fluid can flow thereto from the controller chamber as the controller valve member opens.

6. The combination of claim 5, further characterized by:

A. said bypass valve chamber being connected with the inlet so as to be held closed by pressure of inlet fluid in said chamber at times when the valve spool is in its working position;

B. and means operable in the working position of the valve spool to also communicate the bypass valve chamber with the feeder passage.

7. In combination with a control valve having valve means to direct pressure fluid from an inlet to a motor port:

A. a relief valve mechanism comprising inlet connected relief passage means, relief valve means to normally close said passage means but adapted to open under force which inlet fluid exerts thereon, and an inlet connected pressure chamber from which fluid must exit before the relief valve means can open;

B. first and second valve members which govern flow of fluid out of said chamber, and which are at all times exposed to inlet fluid pressure to be opened under forces exerted thereon by inlet fluid at abnormally high pressures;

C. means exerting a first force on said first valve member to normally hold the same closed;

D. means for translating the pressure of fluid directed to the motor port by said valve means into an additional closing force on said first valve member; and E. means yieldingly holding said second valve member closed with a force which exceeds the total of said first and additional closing forces on said first valve member.

8. The combination of claim 7, further characterized by:

A. said valve means being operable to direct pressure fluid from the inlet to either of a pair of motor ports; and B. means for translating the pressure of fluid directed to either motor port by said valve means into said additional closing force on said first valve member.

9. In combination with a control valve having valve means movable from a neutral position to a working position providing for flow of pressure fluid from a pressure fluid inlet to a motor port:

A. means providing a bypass through which inlet fluid can flow in bypass relation to said valve means;

B. valve mechanism having a bypass valve member normally closing said bypass but adapted to open under force which inlet fluid exerts thereon, and having a pressure chamber from which fluid must exit before the bypass valve member can open;

C. restricted passage means at all times communicating said chamber with the inlet;

D. means providing a passage through which fluid can exit from said chamber;

E. a controller at all times communicated with said pressure chamber and having a valve element to govern flow through said passage, said valve element having a surface upon which inlet pressure fluid from said chamber can act to effect opening thereof;

F. yieldable means holding said valve element closed with a substantially light force which can be readily overcome by pressure of inlet fluid in said chamber whenever said control valve means is in its neutral position; and G. means for translating the pressure fluid directed to the motor port by the control valve means into an additional force on said controller valve element great enough to then hold it closed against the opening force exerted thereon by inlet fluid in said pressure chamber.

10. The combination of chain 9, further characterized by:

A. means providing a venting passage for said pressure chamber; and

B. means rendered operable to close said venting passage in consequence of movement of the control valve means out of its neutral position toward said working position thereof.

11. The combination of claim 9, further characterized by:

A. means providing a relief valve connected with the control valve inlet and adapted to open under force which inlet fluid exerts thereon; and B. yeildable means holding said relief valve closed with a force that exceeds the total of said closing forces on the controller valve element.

* * * * *